US009698923B2

(12) United States Patent
Posner et al.

(10) Patent No.: US 9,698,923 B2
(45) Date of Patent: Jul. 4, 2017

(54) TRAFFIC INFORMATION CLIENT DEVICE

(75) Inventors: Stefan Posner, Munich (DE); Rico Schuster, Munich (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 714 days.

(21) Appl. No.: 13/149,539

(22) Filed: May 31, 2011

(65) Prior Publication Data

US 2011/0298637 A1 Dec. 8, 2011

(30) Foreign Application Priority Data

May 28, 2010 (EP) ..... 10164219

(51) Int. Cl.
*H04H 20/55* (2008.01)

(52) U.S. Cl.
CPC ..... *H04H 20/55* (2013.01)

(58) Field of Classification Search
CPC ..... G08G 1/092–1/093; G08G 1/0962–1/096827; G01C 21/3492; H04H 20/55
USPC ..... 701/1, 117–119, 32.3–32.4, 33.2–33.4, 701/400–431, 538–541; 340/905, 340/988–996
See application file for complete search history.

(56) References Cited

U.S. PATENT DOCUMENTS 6,226,646 B1 5/2001 Geurts
6,438,561 B1 * 8/2002 Israni et al. ..... 455/457
6,535,140 B1 3/2003 Goss et al.
2005/0240340 A1 * 10/2005 Ishikawa et al. ..... 701/117
2005/0259606 A1 * 11/2005 Shutter et al. ..... 370/317
2007/0038363 A1 * 2/2007 McGrath ..... 701/117
2008/0091337 A1 * 4/2008 Hong ..... 701/117
2009/0105940 A1 * 4/2009 Bitan ..... 701/201
2009/0105949 A1 * 4/2009 Bitan ..... 701/212
2009/0140889 A1 * 6/2009 Mohaupt et al. ..... 340/995.13
2009/0237270 A1 * 9/2009 Saunders ..... 340/905
2010/0017120 A1 * 1/2010 Hessling et al. ..... 701/209
2010/0082227 A1 * 4/2010 Posner et al. ..... 701/118

FOREIGN PATENT DOCUMENTS

CN 1190481 A 8/1998
JP H08251054 A 9/1996
JP H08265281 A 10/1996
(Continued)

OTHER PUBLICATIONS

Chinese Office Action and English translation for corresponding Application No. 201110141852.9, mailed Jul. 6, 2016, 34 pages.
(Continued)

*Primary Examiner* — Orlando Bousono
(74) *Attorney, Agent, or Firm* — Brooks Kushman P.C.

(57) ABSTRACT

The invention provides an electronic device configured to operate as a traffic information client. The traffic information client device comprises an interface adapted to receive traffic information messages, where a traffic information message comprises a location code which identifies a location of a traffic event. The traffic information client device further comprises a memory and a relational database stored in the memory, the relational database comprising at least a first set of relations including at least one relation which directly or indirectly associates location codes with location information.

27 Claims, 6 Drawing Sheets

(56) References Cited

FOREIGN PATENT DOCUMENTS

| | | | |
|---|---|---|---|
| JP | 946244 | A | 2/1997 |
| JP | H10503026 | A | 3/1998 |
| JP | H11511279 | A | 9/1999 |
| JP | 2008123278 | A | 5/2008 |
| WO | WO 97/34275 | A2 | 9/1997 |

OTHER PUBLICATIONS

Canadian Official Action for corresponding Application No. 2,734,366, mailed Jun. 19, 2013, 3 pages.
Canadian Official Action for corresponding Application No. 2,734,366, mailed Jun. 3, 2014, 6 pages.
Canadian Official Action for corresponding Application No. 2,734,366, mailed Aug. 27, 2015, 7 pages.
European Extended Search Report for corresponding Application No. 10164219.7, mailed Feb. 8, 2011, 6 pages.
Japanese Official Action and English translation for corresponding Application No. 2011-084089, mailed Oct. 27, 2014, 5 pages.
Japanese Official Action and English translation for corresponding Application No. 20111084089, mailed Jul. 1, 2015, 5 pages.
Chinese Office Action and English translation for corresponding Application No. 201110141852.9, mailed Mar. 11, 2016, 31 pages.
Chinese Office Action and English translation for corresponding Application No. 201110141852.9, mailed Jun. 30, 2015, 29 pages.
Japanese Notice of Allowance and English translation for corresponding Application No. 2011-084089, mailed Dec. 1, 2015, 6 pages.

* cited by examiner

TRAFFIC INFORMATION CLIENT DEVICE

RELATED APPLICATIONS

This application claims priority of European Patent Application Serial No. 10 164 219.7, filed on May 28, 2010, titled TRAFFIC INFORMATION CLIENT DEVICE, which application is incorporated in its entirety by reference in this application.

BACKGROUND OF THE INVENTION

1. Field of the Invention

The invention relates to a navigation device, and in particular, an electronic device configured to operate as a traffic information client, such as a traffic message channel or transport protocol expert group client device, and a method for operating the same.

2. Related Art

Navigation and, in particular, the orientation when driving a vehicle is facilitated by the use of navigation devices, which generally use the global positioning system (GPS) to determine a current position. An indication of the current position together with routing information is provided to a user by means of visible or audio output. Navigation devices usually comprise map data upon which the route to a destination entered by the user or the driver can be calculated. Map information stored on a conventional navigation device is only static, so that when a particular road becomes impassable or blocked (e.g., due to an accident or road works), this is not considered in the route determination.

This drawback was overcome by the introduction of the traffic message channel (TMC). The TMC provides a means for delivering current traffic and travel information (TTI) to the navigation device and the driver. The information on the TMC is generally digitally coded and transmitted by means of a conventional FM radio broadcast. In addition to the TMC, the transport protocol experts group (TPEG) protocol provides a new/additional way of transmitting traffic messages. The TPEG may be used to transport dynamic information about road status to a client device.

TMC or TPEG messages comprise event codes (EC) and a location description, which, in case of TMC will be (and in case of TPEG can be) a location code (LC), and may comprise further information, such as a time limitation (or effect duration), information on the country to which the messages relate, and the like. The event and the location code have to be translated at the client device into information that can be given out to a user, such as into a particular traffic event and a location on the road network. For this purpose, the Traffic Information software (using the TMC and/or TPEG protocol) operating the client device comprises an event code table and a location code table (if TMC locations are the chosen referencing method in case of TPEG).

The event code table and the location code table may be incorporated into conventional devices as either part of the software or stored in the database of the TMC/TPEG client. The tables are stored on the TMC/TPEG client device as binary large objects (BLObs). Such a configuration has several disadvantages. Updating of the event code table and the location code table is difficult and, if the tables are embedded in the software, has to occur together with an update of the TMC/TPEG client software (i.e., the software operating on the client device needs to be updated or re-installed). Similarly, updating the tables is difficult if they are stored as BLObs in a database. The pre-installed TMC tables are generally only appropriate to the market in which the respective TMC/TPEG client devices are sold, and they comprise the TMC event codes and location codes only up to the time of their manufacture. Besides updating, expanding the event and location code tables, for example with a new user language, is difficult.

Due to these limitations, the functionality of the event code and location code tables is restricted. The information comprised in these tables is further generally not suitable for reproducing a correct speech output for a traffic message. Also new types of information can generally not be added to the existing and standardized event code and location code tables.

Storing the tables in the form of binary large objects further requires a relatively large amount of space. When accessing information in the tables, the whole object needs to be loaded into the main memory of the client device, which requires a large amount of main memory and reduces the performance of the device. Similarly, when retrieving data from the tables, access is slow. Present TMC/TPEG client devices accordingly operate rather inefficiently, and are very inflexible regarding the updating or the addition of new information.

In view of the foregoing, a need therefore exists for a traffic information client device that decodes traffic messages with improved versatility and flexibility.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an electronic device configured to operate as a traffic information client is provided. The electronic device includes an interface adapted to receive traffic information messages, where a traffic information message includes a location code which identifies a location of a traffic event, a memory, and a relational database is stored in the memory. The relational database includes at least a first set of relations including at least one relation which directly or indirectly associates location codes with location information. The electronic device further includes a processing unit adapted to query the relational database with a location code received with a traffic information message in order to retrieve the associated location information from the relational database.

The traffic information message may further include an event code which identifies a traffic event, and the relational database may further include a second set of relations including at least one relation which directly or indirectly associates event codes with event information. The processing unit can then be adapted to query the relational database with an event code received with a traffic information message in order to retrieve the associated event information from the relational database.

By storing the event codes and/or the location codes in a relational database, the corresponding information can be easily updated and the database can be easily extended. Further, the event information and the location information can be distributed over several relations of the relational database, for example, according to the type of information. Naturally, said at least one relation may also directly and indirectly associate event/location codes with event/location information. A compact database can thus be achieved. Only the relations including the requested information need to be accessed when querying the database. It is thus possible to conserve storage space and reduce the amount of required working memory, and the retrieval of information from the database is further accelerated. A search query of the processing unit may comprise an event code, a location code or both, and it may certainly include further information, such as a country code (cc), an extended country code (ecc), a location table number (ltn) or the like.

According to another implementation, a method of operating an electronic device configured to operate as a traffic information client is provided. The electronic device may include an interface for receiving traffic information messages and a relational database comprising at least a first set of relations including at least one relation which directly or indirectly associates location codes with location information. The method includes the steps of receiving on the interface a traffic information message comprising a location code which identifies a location of a traffic event, querying the relational database using the location code as a search query, and retrieving location information associated with the location code from the relational database.

According to yet another implementation, an electronically readable data carrier is provided that includes a relational database stored thereon. The relational database includes at least a first set of relations including at least one relation which directly or indirectly associates location codes with location information.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
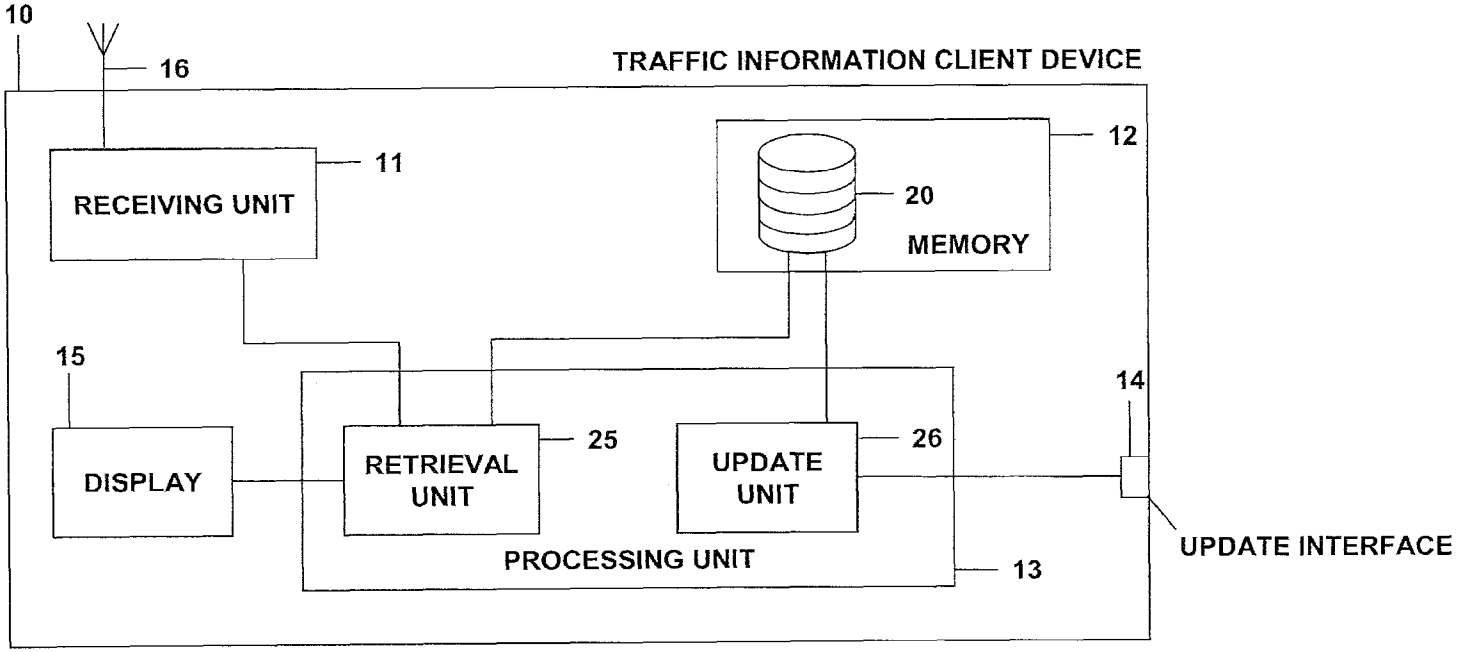
FIG. 1 is a schematic diagram illustrating one example of an implementation of a TMC client device of the present invention.

The following implementations of the present invention will be described in detail with reference to the accompanying drawings. It is to be understood that the implementations described below are given only for the purpose of illustration and are not to be taken in a limiting sense. The drawings are to be regarded as being schematic representations only and elements in the drawings are not necessarily to scale with each other. The physical or functional blocks or units shown in the drawings are not necessarily implemented as physically separate units, but the blocks or units shown or described may be implemented as separate units, circuits, chips or circuit elements, or may as well be implemented in a common circuit, chip, circuit element or unit.

While the implementations below refer to a TMC client device receiving TMC messages, it should be noted that implementations of the present invention may vary and that any type of traffic information client device is covered by the present invention, such as a TPEG client device receiving TPEG messages. In particular, the implementations described below with respect to the processing of a location code received with a TMC message are equivalently applicable to the processing of a location code received with a TPEG message in a TPEG client device using TMC location referencing.

Turning now to the figures, FIG. 1 shows a schematic block diagram of one example of an implementation of a traffic information client device 10 of the present invention. The traffic information client device 10 may be adapted to operate as a TMC, TPEG, or any other suitable client device. In this implementation, the device 10 is adapted to receive and interpret TMC messages and/or TPEG messages. Information included within the received TMC or TPEG messages is processed by the traffic information client device 10 and presented to a user of the device. Although the device 10 is described in this implementation as a TMC client device, persons skilled in the art will appreciate that the description is equally applicable to a TPEG client device that received TPEG messages.

As illustrated, the TMC client device 10 may include a receiving unit 11 adapted to provide an interface for receiving TMC messages. TMC messages are generally transmitted by using an FM-broadcasts, the messages being digitally coded using the FM-radio data system (RDS). Accordingly, receiving unit 11 may include an RDS enabled FM receiver. Besides conventional FM radio broadcast, TMC messages may also be transmitted on digital audio broadcasting (DAB) or on satellite radio. Receiving unit 11 may accordingly also be adapted to receive TMC messages on these channels. In other implementations, receiving unit 11 is adapted to receive TMC messages from any source providing such messages. When implemented as a TPEG device, receiving unit 11 may be adapted to receive TPEG messages that are transmitted using a digital broadcast (e.g. DAB) or a point-to-point connection, such as a cellular/internet connection. However, in general, any digital bearer may be used since TPEG is designed to be bearer-independent, and accordingly, any type of TPEG message may be received by receiving unit 11.

TMC client device 10 further includes a processing unit 13 adapted to process received TMC messages. Processing unit 13 controls the operation of the TMC client device 10 according to control programs stored in memory unit 12. Processing unit 13 may be implemented as a single or multiple microprocessors in the form of a general purpose or special purpose microprocessor, or one or more digital signal processors or application-specific integrated circuits. The memory unit 12 may include all forms of memory, such as random access memory (RAM), flash memory, or a hard drive. Some of these types of memory may be removable from the device 10, such as a flash memory card, or the like.

Processing unit 13 includes the functional units 25 and 26, which may, for example, be implemented as software code portions running on the processing unit 13. The retrieval unit 25 may be adapted to analyze an incoming TMC message for information comprised therein, such as a TMC event code (in case of TPEG messages: TPEG codes, not part of this patent), a TMC location code, a country code (cc), an extended country code (ecc) (if supplied), a location table number (ltn), an event quantifier, a location offset, a direction, and the like. When implemented as a TPEG client device, the retrieval unit 25 may extract a TMC location code, as well as cc, ecc (if supplied) and ltn from a TMC location container comprised in a received TPEG message, and may further extract TPEG event codes and the like from the TPEG message.

Retrieval unit 25 includes search queries from the information extracted from received TMC messages and uses these to query the relational database 20 stored in memory 12 in order to retrieve corresponding event or location information. From the information retrieved from database 20, the processing unit 30 assembles a graphical or a text message which can be given out to a user of the TMC client device 10 by means of display 15. In other embodiments, a voice messages is compiled which is given out to the user of TMC client device 10 by means of a loudspeaker (not shown).

A received TMC message may include any information as defined in the TMC standard (e.g. the ALERT C standard, or ISO 14819). When decoding a received TMC message, processing unit 13 needs to identify the type and the position of the corresponding traffic event. The type of the traffic event is identified by means of the event code. The event code may, for example, indicate "stationary traffic", "queuing traffic", "slow traffic", or the like. The location code included in the TMC message identifies the location of the traffic event and can be decoded by using a corresponding location table. As the location tables for different countries may include the same location codes, the additional values cc, ecc and ltn are used to uniquely identify the country and the location table to be used. The start and end positions of a traffic jam can then be identified from the location code identifying starting position of the traffic jam, and a direction and offset identifying the extension of the traffic jam. Processing unit 13 is adapted to retrieve the corresponding information from the relational database 20 and to give out a corresponding message, such as "queuing traffic for 4 km between Munich and Munich airport."

A received TPEG message may include any information as defined in the TPEG standard (ISO 18234 series or ISO 21219 series). The location content of a TPEG message, if it uses TMC location referencing, is processed in an analogous way to the location part of TMC messages.

While in conventional systems the event tables and location tables are included in the TMC or TPEG client software and stored in form of a binary large object, the present invention provides a relational database 20 comprising the event and location information. One implementation of a relational database 20 of the present invention is illustrated in FIGS. 2 and 3.

Figure 2:
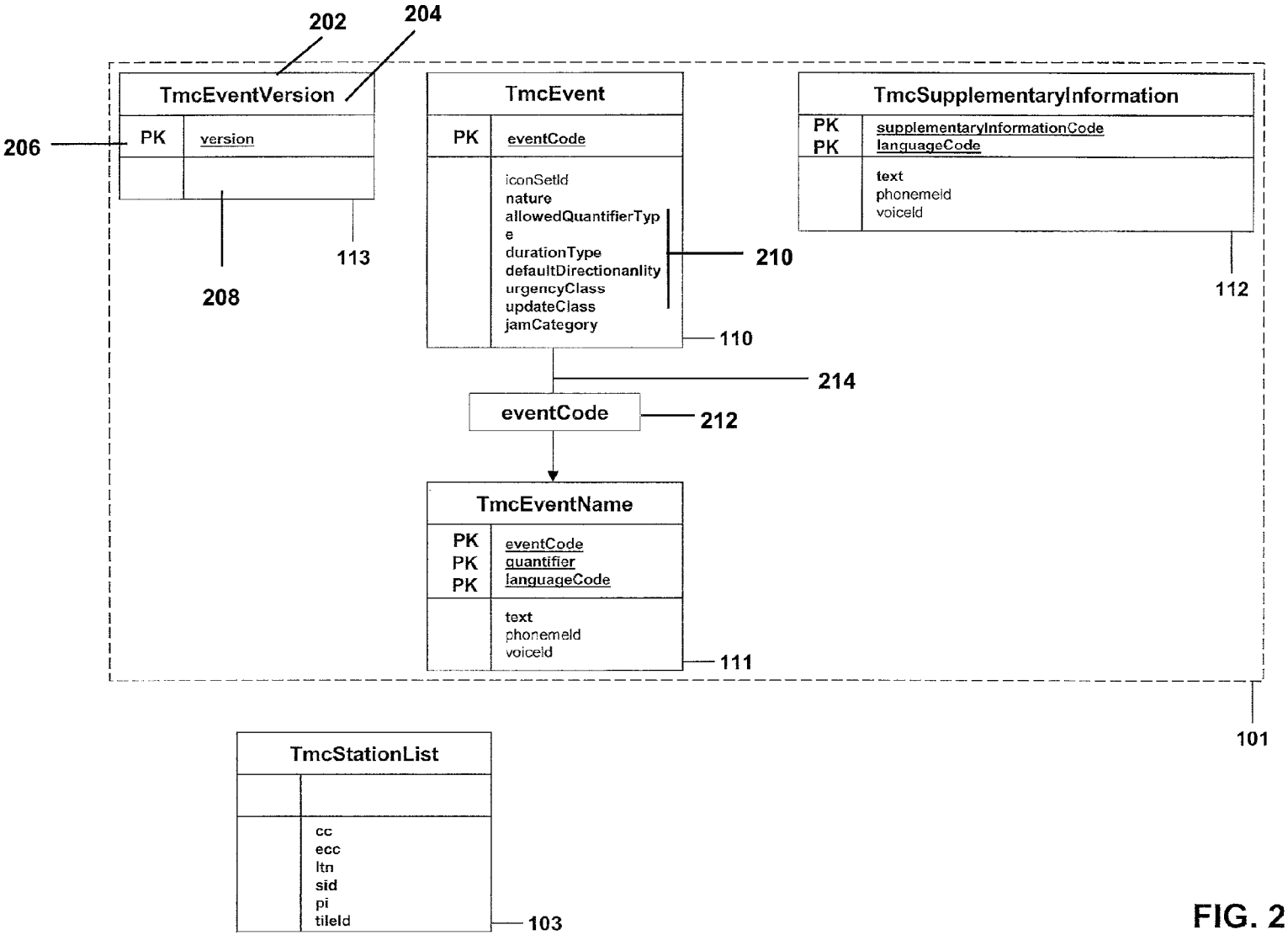
FIG. 2 is a schematic diagram illustrating one example of a relational database of the present invention.
Figure 3:
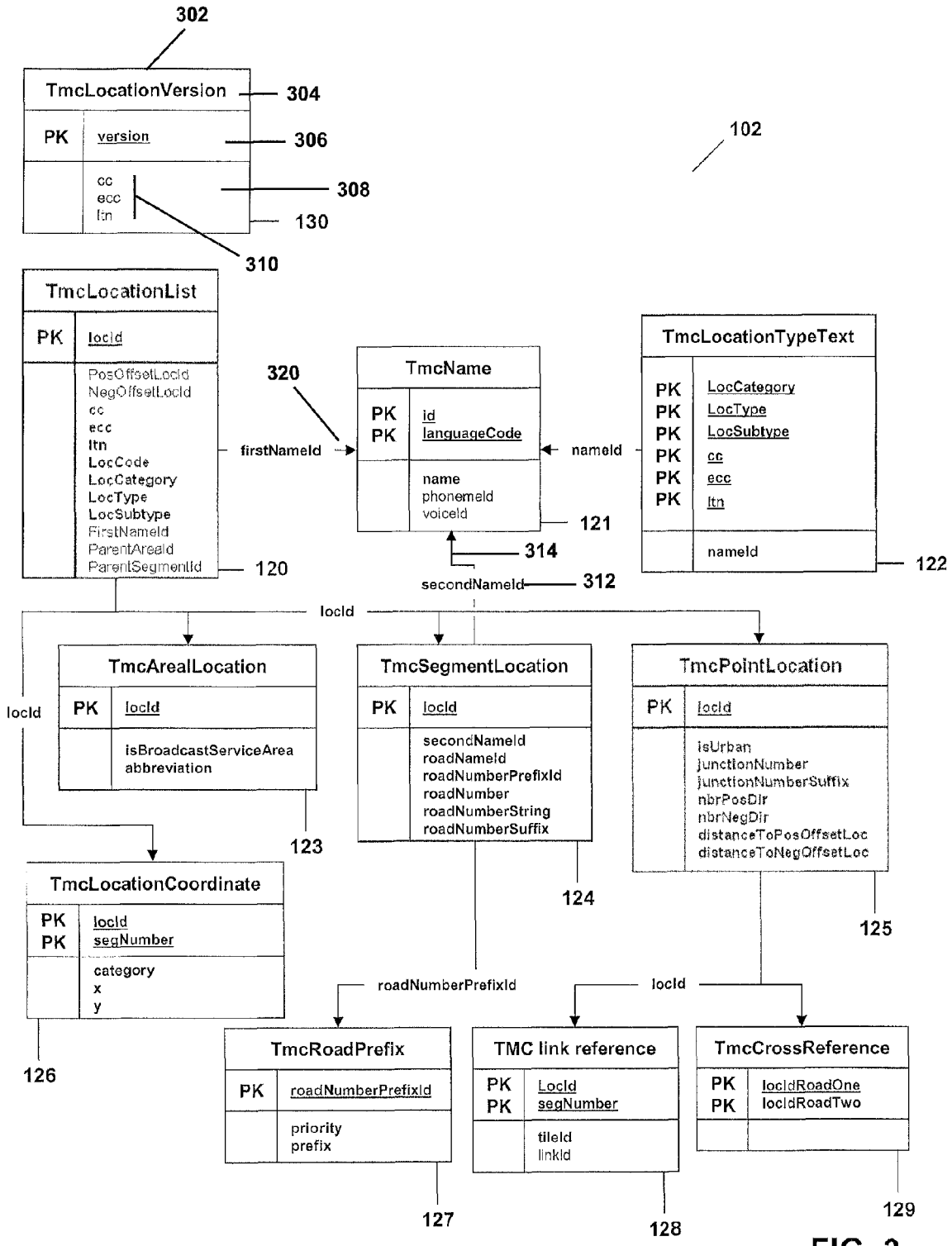
FIG. 3 schematically illustrates further relations of the relational database according to the TMC client device of FIG. 2.

As shown in FIGS. 2 and 3, the relational database 20 includes at least a first set of relations 102 (FIG. 3) and a second set of relations 101 (FIG. 2) comprising location information and event information, respectively. While both sets of relations are generally provided in a TMC client device, a TPEG client device may only include the first set of relations for TMC location referencing. Yet a TPEG client device may also include a database having a second set of relations associating TPEG event codes with event information.

The first set of relations may include a first relation having a plurality or records with location codes for different countries, where the records for different countries may include the same location codes, and where the first relation includes an attribute associating each record of the first relation with a unique location identifier. For example, to access a particular record of this first relation (in the following also called location list relation), a search query may include the location code and one or a combination of cc, ltn, and, if provided, ecc. The unique location identifier ("locId") associated with the accessed record may be retrieved and used for accessing records in other relations instead of the three or four afore-mentioned attributes. In that way, access to further location information is thus facilitated and accelerated. Each record of the first relation may, for example, associate a location code, a country code, an extended country code (where available) and a location table number with the unique location identifier.

The indirect association between the location code and the location information mentioned above may be provided in the following way. The first set of relations may include a first relation associating the location code with an identifier, preferably a unique location identifier and/or a location name identifier, and may further include one or more second relations each for a particular type of location information with each of the second relations associating the identifier with the corresponding location information. The identifier may also be termed "foreign key" and may be a reference to a record in another relation. It is thus possible to split up the location information into plural relations, while all the information is still accessible directly or indirectly by means of the location code. The first relation may certainly also directly associate the location code with further location information. In the second relation, the identifier may be used as a primary key or as part of a primary key. After retrieving the identifier from the first relation, it can then be used in a search query for retrieving location information from the second relation.

In particular, the second and first set of relations 101 and 102 are illustrated in FIGS. 2 and 3 by rectangles and denoted by reference signs. Each relation 202, 302 includes a series of rows. The first row (e.g., rows 204, 304) may include the name of the relation. In the next set of rows (e.g., rows 206, 306), the attributes of the relation which can be used as a primary key (PK) are identified. The third set of rows (e.g., rows 208, 308) may include further attributes 210, 310 of the relation. The further attributes 310 of each relation which are mandatory in the present example are presented in a bold font, whereas optional attributes are presented in a regular font. It should be clear that in other embodiments other attributes may be mandatory or optional. A relation may include an attribute with a foreign key 312 (FIG. 3) which can be used to identify a record in another relation. This is illustrated by the lines 314 between the relations, indicating the foreign key for accessing records in the relation towards which the line connects, as will be described in detail below.

In particular, as shown in FIG. 2, the second set of relations 101 may include two relations 110 and 111 directly associating an event code with event information. In other implementations, only one such relation may be provided, or relations indirectly associating the event code with event information may be provided.

The event relation 110 directly associates an event code, which is used as a primary key (PK), with several attributes comprising event information, which are described in further detail below. Each relation may be imagined as a table with the attributes forming the columns of the table and the records, also called tuple or relationship, of the relation forming the rows. Each record or table row can be uniquely identified by the primary key. Accordingly, given the primary key, the values of the remaining attributes of the relation or table can be retrieved from the record identified by the primary key.

In some implementations, the first set of relations 102 may further include an event relation associating the event code with at least one or a combination of the following attributes: an icon set identifier identifying an icon set associated with an event code, an event nature identifying the nature of the event, a duration type comprising information for the determination of a duration of the corresponding traffic information message, a default directionality indicating whether the event relates to one or both directions of traffic, an event urgency indicating a urgency of the event, a jam category indicating a severity of the traffic event, an update class which is used by an update mechanism in the client device, and an indication about the quantifier type which is allowed to be used with the event. The icon set identifier can be a foreign key to another relation containing information about icons which can be displayed as an indication for the traffic event on a display of the TMC client device. The jam category attribute may include the textual statements of the event text, where applicable, in a machine-readable form, so that it can be used for the determination of travelling costs in a routing application.

For example, the TMC event relation 110 includes texts and additional information for each event code, which can be used for, for example, message management. The primary key "eventCode" is the event code as received in the TMC message. The attribute "iconSetId" includes an icon set identifier which is a link into a separate table (not shown) containing information about the icon which can be displayed on the display of the navigation device. For each traffic event, one type of icon may be provided in the separate table (e.g., several cars displayed within a triangle with red frame for the traffic event "traffic jam"). As there can be several occurrences of a "traffic jam" icon on a display of a TMC client device, which may vary in size, color (e.g., for daytime or night-time icons) and so on, a whole set of icons may be assigned to each traffic event. Using further information, such as the current time or the display size, the appropriate icon may be retrieved.

Relation 110 further includes the attribute "jamCategory," which describes in a machine-readable form the textual statements of event text corresponding to the event code, such as "heavy traffic" or "slow traffic." These may be provided to, or retrieved by a routing unit (not shown) of TMC client device 10. When such a unit determines a route from a starting point to a destination, it can consider the jam category in order to determine routing costs for the respective road segment. While the event text associated with an even code gives traffic jam related information only as a text string, the jam category attribute can provide this information directly in a numeric format, avoiding a time-consuming language-dependent analysis of the event text.

Relation 110 includes a number of other attributes associating the event code with event information. These other attributes include an event "nature" attribute describing the nature of the traffic event, and an "allowedOuantifierType" attribute determining a type of quantifier that can be used with the event code, such as the average velocity of slowly moving traffic. The "durationType" attribute determines the duration of a message and can be used for message management, for example, the persistence of a particular traffic event, by the TMC client device. As an example, "D" can indicate dynamic events of a short duration, and "L" can indicate longer lasting events. If the code is put in brackets, the duration information is not presented to the user of the client device in the present example.

Additional attributes in the TMC event relation 110 include the "defaultDirectionality" attribute indicating whether the traffic event is relevant for one or both directions, the "urgencyClass" of the "updateClass," which is used by an update mechanism for message management by the TMC client device.

The event name relation 111 directly associates an event code with an event text. For the same event code, the corresponding event text is provided in different languages in relation 111. Accordingly, the attribute "languageCode" needs to be used as a primary key together with the "eventCode" attribute. Further, the event text can be provided without quantifier, for a singular quantifier or for a quantifier larger than one. Accordingly, a "quantifier" attribute is used in the primary key for indicating for which type of quantifier the traffic event text should be retrieved. For the plural form, the event text can, for example, include a placeholder. The stored event text for a singular/plural form can, for example, be: "accident involving (a/Q) heavy lorr(y/ies)". For a quantity of three, the event text may then read "accident involving 3 heavy lorries". For the singular form, the event text may read "accident involving a heavy lorry."

Hard coded values in the event text can be marked in a specific way, for example, by putting the numbers between "$" characters.

If the event text contain a quantifier placeholder, it may be marked by specific characters which can be replaced by the actual value and unit of the quantifier. For example, the event code "108" may be associated with the event text "queuing traffic (with average speeds of $Q$)", with $Q$ being replaced by the quantifier if submitted. If not, the text within the brackets may be removed when displaying the corresponding text message.

In some implementations, the event name relation or the location name relation can associate the event text or location name with a phoneme identifier for retrieving a phoneme representation of the corresponding event text or location name, respectively. These relations may additionally or alternatively associate the event text or location name with a voice identifier for retrieving an acoustic representation of the corresponding event text or location name, respectively. The phoneme identifier and the voice identifier can thus function as foreign keys for retrieving the corresponding phoneme representation or acoustic representation from further relations provided in the relational database. By providing a phoneme representation or even an acoustic representation, such as a sound file, for a text string, the speech output of a corresponding text can be significantly enhanced.

For example, the "phonemeId" attribute in event name relation 111 comprises a phoneme identifier which refers to a record of a table containing the phonetic representation of the associated event text string. This can be used to enhance the quality of speech output. Similarly, the attribute voiceId comprises a voice identifier referencing an entry in a table comprising pre-recorded voice output. The pre-recorded voice output may for example be an mp3 file which can be played back by an mp3 decoder for providing the corresponding traffic message to the user. It should be clear that these attributes are optional and may be void for some records.

Relation 112 includes a TMC supplementary information list. Relation 112 associates supplementary information codes as received with TMC messages with a text attribute comprising text strings with corresponding information. The text may again be provided for different languages, so that the language code is used together with the supplementary information code as a primary key. As mentioned above with respect to relation 111, relation 112 may further include attributes for a phoneme identifier (phonemeId) and a voice identifier (voiceId).

The relation 113 holds the version number of the TMC events. In the present example, all event codes are of the same version. It is generally not required to hold several versions of TMC event codes.

In other implementations of the present invention, one or more second relations may be provided that include at least one of the following relations: an area location relation with area location information, a segment location relation with segment location information, a point location relation with point location information, a location name relation with location name information, a location type relation with location type information and a location coordinate relation with coordinate information. Compared to a configuration in which all these types of information are provided in a single relation, this configuration has the advantage that empty data fields in the relation are avoided, for example, for a location code corresponding to a point location for which segment location and area location data fields would be empty. By distributing the information over plural relations, the performance of accessing the data can further be improved and the required storage space of the database is minimized.

FIG. 3 shows the first set of relations 102 including relations which directly or indirectly associate location codes with location information. The set 102 includes a relation 120 which directly and indirectly associates the location code with location information. Each record of the location list relation 120 can be uniquely identified by the attributes "cc" (country code), "ecc" (extended country code), "ltn" (location table number), and "locCode" (location code). Accordingly, these attributes may be used as search query for retrieving a particular record from relation 120. To facilitate the identification of records and to further accelerate the access to records in associated relations, the "locId" attribute is provided which includes a unique location identifier for each record. This unique identifier corresponds to a surrogate key, which in relation 120 is used as a primary key.

Relation 120 may thus include location codes for different countries, even if these countries use the same location codes. Since each country may allocate more than one location table (ranges of corresponding ltn-values are defined in the TMC norm), the attribute "ltn" can be used together with "locCode," "cc" and "ecc" to uniquely identify a location on a world-wide basis. For each location, information is provided in each record on the location category ("locCategory"), the location type ("locType"), and the location subtype ("locSubtype"). The "locCategory" attribute indicates whether the location is an area, a linear (also called segment) or a point location. The "locationType" can, for example, be a junction or the like. The subtype further specifies the location type, e.g. a junction in form of a motorway exit. The value of these attributes can be retrieved when querying relation 120 either with the primary key "locId," or with the four attributes "cc," "ecc," "ltn," and "locCode." An example result returned by database 20 (FIG. 1) could be "P1.4", with "P" indicating a point location, "1" indicating the type "junction," and "4" indicating a motorway exit.

Relation 120 may also include the attributes "posOffsetLocId" and "negOffsetLocId." The "posOffsetLocId" and "negOffsetLocId" attributes comprise the unique location identifier for the next location in positive or negative direction, respectively, according to the location list relation 120. These attributes can also be null or void. Preceding or subsequent locations can thus easily be identified.

The attributes "parentAreaId" and "parentSegmentId" comprise the unique location identifier for the area location and segment location, respectively, for locations higher up in the hierarchy. This can be advantageous in order to identify the road segment on which a point location, such as a motorway exit, is located. This is particularly advantageous for situations where a name of a location is not sufficient to describe the location unambiguously, so that areas or segments higher up in the hierarchy are needed. An example would be "Bahnhofstraβe", "in Neumarkt", and "in der Oberpfalz", with only the three names of different hierarchy describing the location unambiguously.

The "firstNameId" attribute includes a location name identifier referencing a record in the TMC name relation 121, and thus corresponds to a foreign key. This is indicated by the arrow 320 between relations 120 and 121. These relations accordingly provide an indirect association between the location code and the location name. Relation 121 holds all location names in form of text strings. Again, the names may be provided in different languages, so that for the same location name identifier (attribute "id") plural records exist. Accordingly, the attributes "id" and "languageCode" are used as a primary key. The attribute "name" comprises the text string of the location name in the respective language. As mentioned above with reference to relation 111, relation 121 includes phoneme identifier and voice identifier attributes which reference corresponding records comprising a phoneme representation of the location name or pre-recorded voice data for the location name, respectively. Such phonetic information is particularly useful for location names, as some names cannot be correctly pronounced by a text-to-speech engine without addition information (e.g. Leicester, UK).

By providing all the text strings in separate relations 111 or 121, the text strings can be easily updated, and new languages can be added. The corresponding relations simply need to be expanded with additional records comprising the event text or location name in the corresponding language. The language code identified by the processing unit can then be used to retrieve the text in the corresponding language. Furthermore, the remaining relations can be kept completely language-independent, simplifying their structure and accelerating access to the records comprised therein.

In one implementation, the set of relation 102 may include a first relation that associates the location code with a location category identifier indicating whether the corresponding location is an area location, a linear location or a point location. The processing unit 13 (FIG. 1) may then be adapted to identify the location category of a received location code by querying the relational database and to retrieve, in dependence on the identified location category, further location information either from the area location relation, the segment location relation or the point location relation using the identifier, preferably the unique location identifier, as a search query. By means of the first relation associating the location code with the unique location identifier and the location category identifier, the processing unit 13 can immediately determine which second relation and which record thereof to access.

The first relation, the segment location relation and/or the location type relation may comprise an attribute associating each record with a location name identifier, the location name relation comprising records associating the location name identifiers with location names. The location name identifier is for example the primary key or part of a primary key of the location name relation. Accordingly, it is possible to store all location names, for example, in the form of human understandable text strings, within a single relation. All other relations only need to comprise an attribute for the location name identifier in order to retrieve a location name. This facilitates the updating or extending of the text representations available for the different locations, as only one compact relation needs to be updated.

For the information that is specific to an area, a segment or a point location, three separate relations 123, 124 and 125, respectively, are provided. The location information included in these relations are again indirectly associated with the location code, by means of the unique location identifier ("locId"). The "locId" attribute is used as a primary key for the three relations. This renders the database more compact and conserves storage space, as empty data fields are avoided, for example, for attributes specific to a segment location in the record of a point location.

The area location relation 123 associates the "locId" with an attribute indicating whether the area is a broadcast service area. This information may be, for example, available for the US, and it may be useful for the station selection strategy of the tuner of the TMC client device 10 (FIG. 1). The attribute abbreviation identifies the abbreviation of a state corresponding to the area, for example, "CA" for California. This may be part of the textual representation of a traffic message on the display of the TMC client device.

In some implementations, the first set of relations 102 may further include a segment location relation directly or indirectly associating a location code with at least one or a combination of the following attributes: a location name identifier, a road name, a road number prefix comprising a prefix string part of a road number of a segment corresponding to the location code, a road number attribute comprising an integer number part of the road number of the segment corresponding to the location code, a road number suffix comprising a suffix string part of the road number of the segment corresponding to the location code.

In particular, the segment location relation 124 associates a "locId" of a segment location with a location name identifier ("secondNameId"), which references a record in the location name relation 121 (together with the language code). The "firstNameId" (relation 120) and the "secondNameId" may, for example, refer to the starting point and end point of a road segment, such as the A8 between "Stuttgart" and "Munich". The attribute "roadNameId" includes an identifier for retrieving the road name. The road name is generally defined as a text string, such as "Bahnhofsstraβe".

In the present example, the road number, such as "A8", is split into three parts, a prefix string ("roadNumberPrefixId" attribute), an integer road number ("roadNumber" attribute), and a suffix string ("roadNumberSuffix" attribute). For example, a road with the number "B62N" is split into "B"+"62"+"N". This is particularly advantageous when used in combination with a navigation application. A traffic information list displaying traffic information messages can be easily sorted numerically by the integer road number. Furthermore, in a graphical representation of the road number, the prefix may be substituted by a bitmap, such as a yellow sign with black boarders for the German "Bundesstraβe", into which the integer road number is rendered. The prefix information is thus presented in form of the bitmap. The attribute "roadNumberString" is used as a fallback for cases in which the road number does not fit into the pattern prefix+integer road number+suffix.

In relation 124, the prefix is provided indirectly by the attribute "roadNumberPrefixId," referring to a record in the relation 127. This relation associates each prefix identifier with a priority and the actual prefix. This can be done for each country. For example, for Germany, the road number prefix "A" (Autobahn) can be associated with the highest priority, the prefix "B" (Bundesstraβe) can be associated with the next lower priority, and so on. Accordingly, it is possible to sort the traffic information message list on display 15 (FIG. 1) of the client device by the prefix priority as a first criterion and the road number as a second criterion. An example of such a sorted list may be: A1, A10, B2, B11, with the respective traffic information being displayed after the road number.

Similarly, the point location relation 125 associates the unique location identifier with a "junctionNumber" and a "junctionNumberSuffix" attribute by which a junction name is split into an integer number and a string. The sorting of junctions by number and the displaying of a junction in a more intuitive graphical representation thus become possible. Distances between point locations are generally calculated using their coordinates. Relation 125 also includes the "distanceToPosOffsetLoc" and "distanceToNegOffsetLoc" attributes which give the road distance to an adjacent point location in positive or negative direction. This road distance is more realistic than the air distance between two points and thus improves the calculation of route costs in a navigation application which can be triggered by a traffic message. The attribute "isUrban" defines if the location is within or outside an urban area. This information can be used to display the respective city name in addition to the street name, if it is an urban area. The "nbrPosDir" and "nbrNegDir" attributes include the pre-assigned diversion numbers along motorways or, similarly, constructed roads in positive and negative direction, respectively. Generally, one diversion number is provided per location and direction, leading the way to the next entry of the motorway in the corresponding direction.

Relation 128 includes routing links that are related to a point location. The relation may be queried by the unique location identifier of the point location and a sequence number ("seqNumber"), by which links in positive direction are numbered with positive numbers starting with 1, and links in negative direction are numbered with negative numbers. The entry with the sequence number −1 is closest to the location code. The attribute "tileId" includes the tile number of the routing tile containing the corresponding link. The "linkId" attribute gives the sequence number of the link within the tile.

The relation 129 includes pairs of unique location identifiers ("locIds") for the point locations. The relation indicates that two point locations identified by "locIdRoadOne" and "locIdRoadTwo" are located on the same physical road. This can occur when two separate motorways, represented by two different sets of point locations, run for a certain distance on the same physical road. In a navigation application, this information can help to find out if two TMC messages, which include different locations, actually refer to the same stretch of road. If two such messages are identified, the navigation system can suppress one of them to avoid displaying redundant information. This sort of filtering of redundant traffic information is particularly useful when more than one traffic information source is received at a time (e.g. more than one radio station).

To facilitate the displaying of traffic information in a map or the calculation of distances between broadcast location and current car position, for example, in order to sort traffic messages by distance in the traffic information list provided on the display, the relational database includes location coordinate relation 126. For all types of locations, relation 126 associates the "locId" with two coordinates (attributes "x" and "y"). In conventional systems, only point locations are provided with coordinates. Relation 126 provides these coordinates also for other types of locations, for example, in the WGS84 format. Attribute "category" identifies the coordinate type, such as area, line, point_center, and point_positives_start. For an area, the outline is formed of positions of subordered points of the area location. All points of one area location have the same "locId" and a consecutive sequence number ("seqNumber"). Attribute "seqNumber" thus identifies the index of the outlined point. This is similar for a segment location. For a point location, the centre coordinates approximating the centre of the location or further coordinates identified by the "category" attribute can be given.

Depending on the type of location (area, linear or point), a location may be described with plural points, which can be addressed by means of the sequence number. Depending on the type of location (and for point locations depending on the concrete coordinate to be described) there are several coordinate categories: an "AREA" type may be used for coordinates describing the outline of an area with several points of a polygon, a "LINE" type can be used for an end point of a linear location (such as a road or a segment of a road) and the five types "CENTRE_POINT", "POSITIVE_START", "NEGATIVE_START", "POSITIVE_END", "NEGATIVE_END" can be used to describe the centre of a point location (for e.g. a large highway intersection, this can be the geographical centre of the intersection). The start coordinate can be used to describe the beginning of a highway intersection on one or the other side of the road (therefore, a coordinate type each for positive and negative direction of a TMC linkage can be provided) and the end coordinate can be used to describe the end of a highway intersection (again, both road directions with separate coordinate types).

In order to complete the textual representation, the location type relation 122 is provided which includes as an attribute a location name identifier ("nameId") referring to a record in the location name relation 121 giving a text representation of a certain type of location. This is again language specific, as both "nameId" and the language code are used as primary key for querying relation 121. In relation 122, the primary key include the attributes "cc," "ecc," and "ltn," identifying the country and location table, as well as the "locCategory," "locType," and "locSubtype" attributes which are retrieved from the location list relation 120. Such a structuring of the database conserves storage space, as not for every location code, a text string for the location type has to be provided. For point codes identifying identical types of locations, only one record needs to be provided in relation 121 per language and, if applicable, per country (a particular type of TMC location may be called differently in different countries having the same language). As a result, relations 120 and 122 can be kept compact.

As an example, the text representation for a motorway exit, which is referenced by "NameId," might be "Anschlussstelle" in German, or "AS" if a shorter text is desired. As the text representation of some location types may vary from country to country, for example, due to a certain level of freedom for assigning road categories, the text representation is provided per country. Accordingly, the "cc," "ecc," and "ltn" attributes are used in the primary key of relation 122. Even though the "cc" and "ecc" attributes would be sufficient to identify a country worldwide, some broadcasters may still use the former combination cc+ltn to identify a country within Europe.

The further relation 130 holds the version number of the different TMC locations. All locations of one location table preferably have the same version. A location table is identified by the three attributes: "cc," "ecc," and "ltn." All entries of all location tables are stored in the location list relation 120. Relation 130 can thus be queried in order to retrieve the version of a particular location table.

Besides the first set of relations 101 and the second set of relations 102, the relational database 20 (FIG. 1) may comprise further relations. For example, as shown in FIG. 2, a station list relation 103 may be provided which associates a sender identifier ("sid") and a program identifier ("pi") with a tile number of the tile in which the sender can be received ("tileId"). Again, this information may be country specific, so that relation 103 includes the further attributes "cc," "ecc," and "ltn." A tuner of the TMC client device 10 may accordingly retrieve useful recommendations from relation 103 concerning the station to tune to when travelling in a certain geographical area. The geographical area identified by the "tileId" attribute may be described using coordinates and may be stored in another part of the database 20.

In particular, the station list relation 103 associates a country identifier included in the received TMC messages with at least one or a combination of the following attributes: a sender identifier indicating a sender broadcasting TMC messages, a program identifier identifying a radio program, a tile identifier describing a geographical area in which the sender is receivable. The country identifier may be one or a combination of cc, ecc and ltn. The area in which a radio station sending TMC messages is receivable may be identified by tiles of different levels. Accordingly, by means of the station list relation, it can be identified which areas are served by which radio stations broadcasting TMC messages.

In some implementations, the first set of relations 120 may further include a cross-reference relation directly or indirectly associating a location code with at least a first unique location identifier and a second unique location identifier, in particular for point locations. In the cross-reference relation, pairs of point locations can be stored which are located on the same physical road. Accordingly, TMC/TPEG messages which refer to the same stretch of road even though they use location codes for different point locations can be identified, and one of the messages can be suppressed to avoid the displaying of redundant information.

In other implementations, the second set of relations 101 may include an event name relation directly or indirectly associating event codes with event texts, said event name relation comprising records for the event text in two or more different languages, the relation further comprising an attribute which identifies the language in which the event text is provided in each record. Preferably, the event name relation directly associates the event name with the event text. The event name relation may include further attributes, such as a quantifier type attribute for indicating with which type of quantifier the relating traffic event text can be combined with. Quantifiers transmitted in a TMC message which describe countable elements (in contrast to physical values like e.g. temperatures) can be singular (the value of the transmitted quantifier is 1) or plural (the value is bigger than 1). In addition, there might be TMC messages sent which contain no quantifier value. For each of the three cases (singular/plural/no quantifier) the event text might require different wording to allow the text generation module of the client device to produce a well formed text representation of the TMC message with inserted quantifier values. The event code, the quantifier type and the language code may then be used as a primary key for accessing a record of the event name relation.

Similarly, the first set of relations 101 may include a location name relation directly or indirectly associating location codes with location names, said location name relation comprising records for the location names in two or more different languages, said relation further comprising an attribute with a language code which identifies the language in which the location name is provided in each record. For the location code, the association is preferably an indirect one. The location name relation may, for example, use the above-mentioned unique location identifier and the language code as a primary key. The location names can be stored in the location name relation in form of text strings.

Accordingly, the relational database can be simply extended with further languages by simply adding corresponding records with language codes to the event name and/or location name relations. Furthermore, all the remaining relations can be language-independent. The updating with a new language can thus be restricted to only these two relations, which is time- and memory-efficient.

For retrieving the text in a particular language, the processing unit may be adapted to determine a current language setting of the electronic device or a user-preferred language, and can use the corresponding language code in a search query for retrieving an event text or a location name from the event name relation or the location name relation, respectively, in the current or user preferred language.

It should be understood that FIGS. 2 and 3 only illustrate one possible configuration of database 20, and that in other implementation, more or fewer relations may be provided, relations may be combined to form one relation, or attributes of one relation may be swapped out to other relations. For example, relations 120 and 122 may be combined so as to provide the "NameId" attribute within relation 120.

Now turning back to FIG. 1, retrieval unit 25 may be configured to query relational database 20 with a search query including the event code and a search query including the location code and the "cc," "ecc," and "ltn" attributes received with the TMC message, thereby retrieving information from, for example, relations 110 and 120, respectively. When implemented as a TPEG client device, the search query may comprise the TMC location code read from the TMC location container in the TPEG message. Based on the retrieved information, such as the "locId," further queries may be sent to relational database 20 to retrieve information from other relations. Using the primary keys indicated, all the information comprised in the relations shown in FIGS. 2 and 3 can thus be retrieved.

The retrieved information is then compiled by retrieval unit 25 into a text or voice message which is given out to a user, for example, by display 15 or a loudspeaker.

As the relational database 20 is decoupled from the TMC client software running on processing unit 13, the database 20 can be easily updated and expanded. For this purpose, an update unit 26 is provided, which is a functional unit implemented by processing unit 13. Update unit 26 interfaces the update interface 14, by means of which data for updating relational database 20 may be received. Update interface 14 can, for example, be implemented as a wired interface, such as a USB interface, a fire-wire interface, an Ethernet interface or the like, or it can be implemented as a wireless interface, for example, a wireless local area network interface, a Bluetooth® interface, a mobile communication interface or the like.

With the update information received on interface 14, the update unit 26 can add or update records, relations, or a whole set of relations of relational database 20. Updating may, of course, also include the removing of records or relations from database 20. For example, update unit 26 may be configured to add event texts and location names for a new language to the relations 111 and 121, respectively.

The traffic information client device 10 may, for example, be implemented as a vehicle navigation device, a personal navigation device (PND), a personal digital assistant (PDA), a mobile communication device, such as a cell phone, a smart phone and the like, or any other device benefiting from receiving and processing TMC and/or TPEG messages. The implementation as a vehicle navigation device or a PND is particularly advantageous, as these devices are generally capable of displaying map information to a user, on which the location of a traffic event obtained from a received TMC/TPEG message can be marked, and a corresponding text message can be given out to a user. As such, traffic information client device 10 may comprise further components that are common to the particular implementation of the device 10. For example, when implemented as a device with navigational functionality, device 10 may comprise a GPS receiver, a map unit for assembling a map to be displayed to a user, and a routing unit for determining a route from a starting point to a destination.

Correspondingly, memory 12 may further include a map database and a routing database, which may be provided separate or as part of database 20. The map unit may display a traffic event indicated by a received TMC/TPEG message by, for example, marking a road section, which can be identified by means of the received location code. The type of the marking may further indicate the severity of the traffic event, for which the map unit may make use of the "jamCategory" attribute of relation 110 (FIG. 2). Similarly, the routing unit can consider costs for a route segment determined in accordance with the "jamCategory" attribute of relation 110 (FIG. 2), or the "distance to positive offset location" of relation 125. By means of relational database 20, routing accuracy and performance can thus be improved.

In other implementations, for example, as a mobile communication device, traffic information client device 10 may include a mobile transceiver adapted for a communication of a mobile telephone network, and further components common to such devices. It should be clear that mobile communication devices may also include a navigational functionality, and accordingly, the features described above may also be comprised in such a device.

Figure 4:
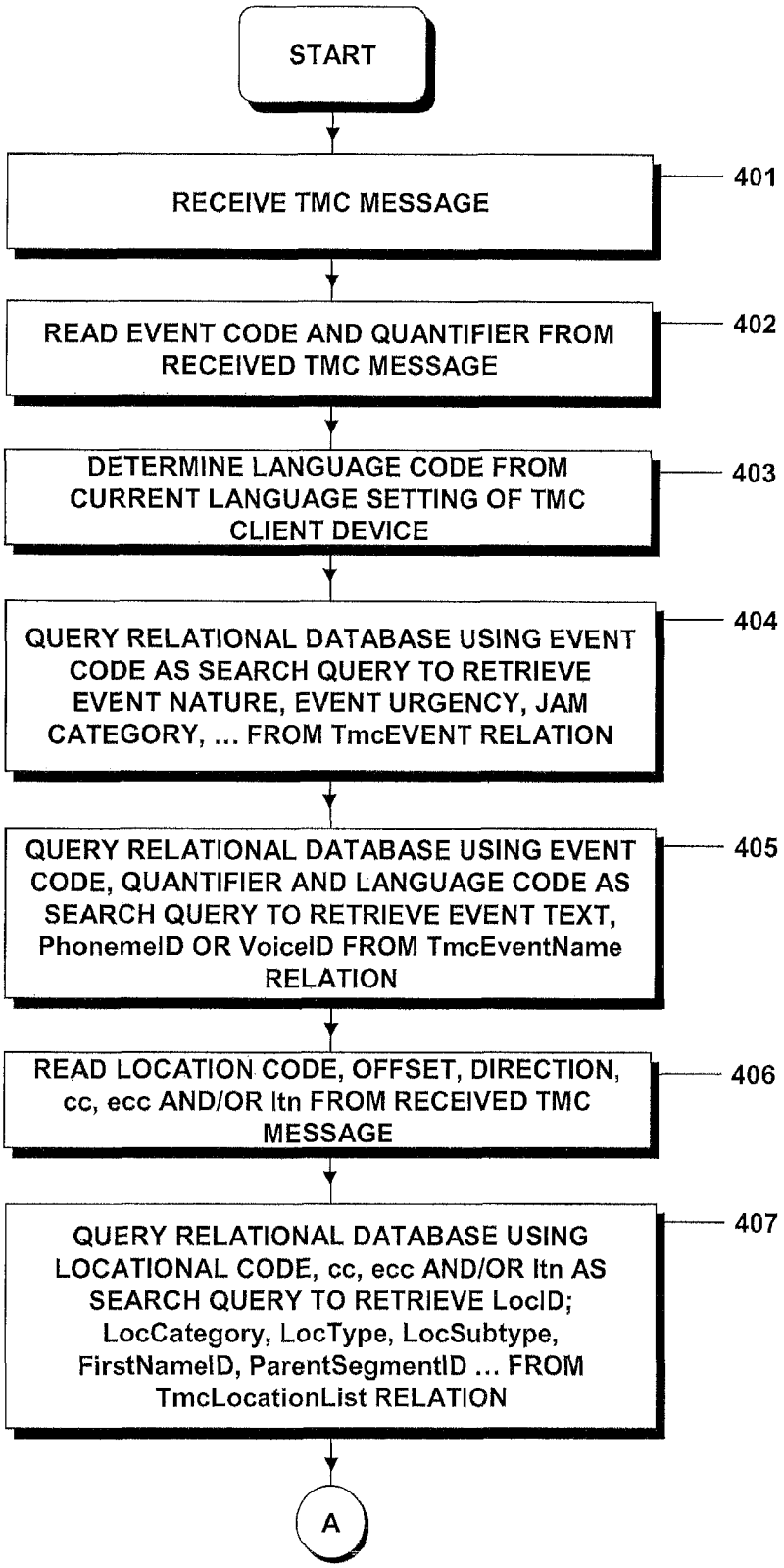
FIG. 4 is a flow diagram illustrating a method for opening the traffic information client device according to an implementation of the present invention.

FIG. 4 shows a flow diagram of a method for operating the traffic information client device 10 when implemented as a TMC client device. In a first step 401, a TMC message is received by receiving unit 11. The eventCode and, if available, a quantifier are read from the received TMC message in step 402. The quantifier indicates, for example, the average speed in a traffic jam. In a next step 403, a language code is determined from a current language setting of the TMC client device 10.

In step 404, relational database 20 is queried with the eventCode as search query to retrieve values for the attributes of relation 110 (FIG. 2). In step 405, the database 20 is again queried using the event code, the quantifier and the languageCode as search query in order to retrieve the event text, and the phonemeId or voiceId from the TMC event name relation 111.

The client device 10 now has the information available for providing a textual representation of the traffic event, such as "heavy traffic for 4 kilometers". In order to determine the location of the traffic event, the location code, an offset and a direction are read from the received TMC message in step 406. In order to identify the originating country, the country code (cc), extended country code (ecc) and location table number (ltn) are further read from the message.

In step 407, using the location code, cc, ecc and/or ltn as a search query, the relational database 20 is queried in order to retrieve the information provided in relation 120, in particular the unique location identifier (locId) and the firstNameId. For example, the location code refers to a point location.

Figure 5:
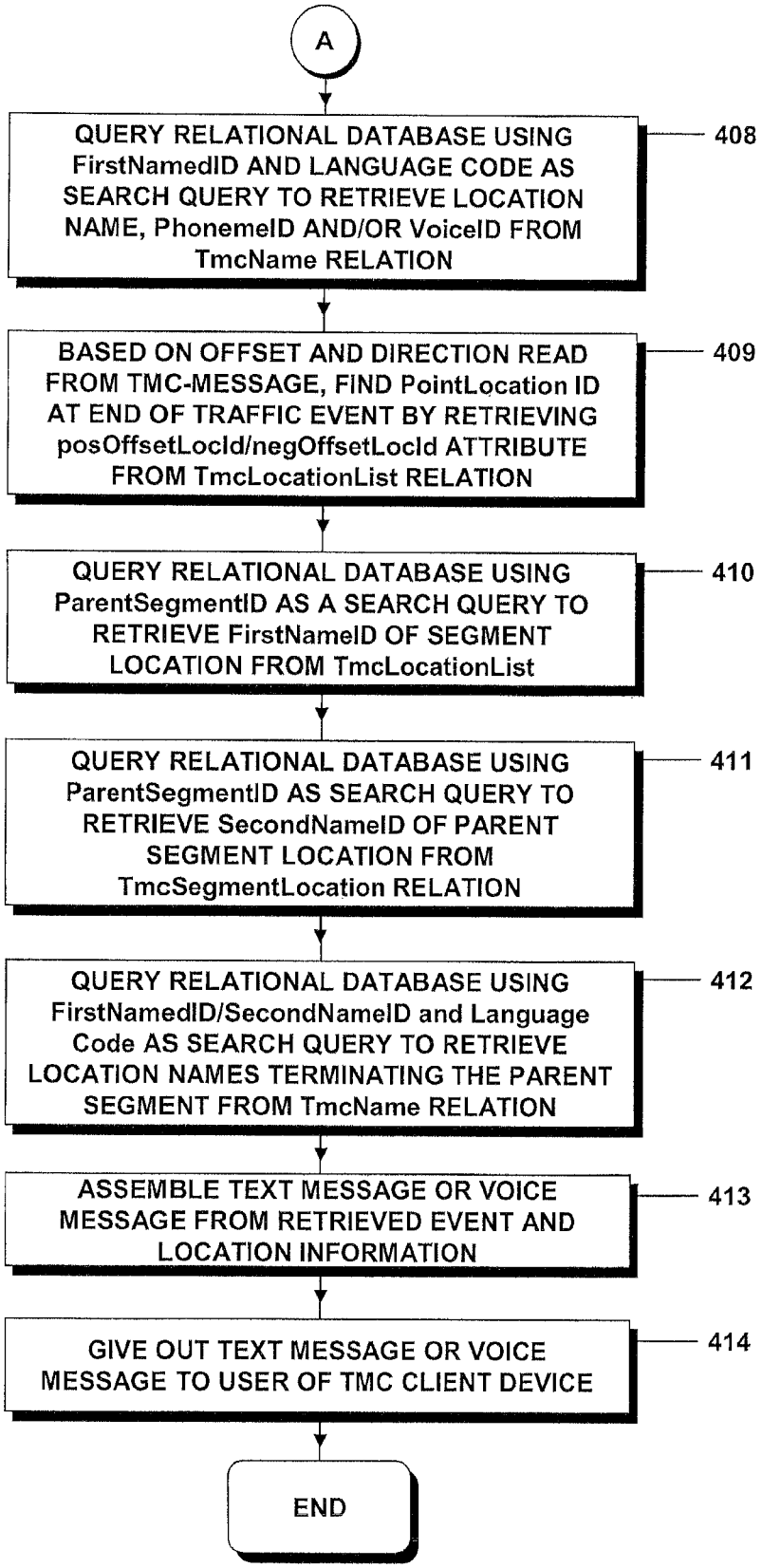
FIG. 5 is a flow diagram further illustrating the method of FIG. 4.

As shown in FIG. 5, using firstNameId and the languageCode as a search query, the location name, the phonemeId and/or the voiceId can be retrieved from relation 121 in step 408. In one example, the name of the point location may be "Sulzemoos." In step 409, the offset value at the direction retrieved from the TMC message can now be used to identify the end of the traffic event by retrieving the locationIds of neighbouring locations by means of the "posOffsetLocId" (or negOffsetLocId" in case of an inverted value of the direction information) attribute of location 120. Using the locationId of the end location and again the languageCode, the corresponding location name can be retrieved from relation 121, e.g. "Odelzhausen". By means of the further attributes retrieved from relation 120 for both point locations, a corresponding NameId may be obtained from relation 122, and can be used to retrieve the location type name from relation 121, e.g. "Autobahnanbindung" for the language DE. By this example, the TMC client device now has the information available that there are four kilometers of heavy traffic between the freeway access "Sulzemoos" and the freeway access "Odelzhausen".

By means of the parentSegmentId of relation 120, the locId of the parentSegment of the point location is further known. This is used in a next step 410 to retrieve the firstNameId of the parentSegment from relation 120. Relation 121 is further queried with the locId of the parent segment in order to retrieve the secondNameId and the further attributes, in particular the roadName or roadNumber in step 411. In step 412, the firstName and secondName identifiers and the languageCode are again used to retrieve from relation 121 the corresponding location names as text strings, and/or a phoneme- or voiceId. For example, the first location name may be "Munich" and the second location name "Stuttgart", which terminate the segment with the roadName "A8". In this way, the client device now has the information available that the traffic event is located on the A8 between Munich and Stuttgart.

It should be understood that the description above is just one example of how processing unit 13 (FIG. 1) may retrieve event and location information from relational database 20. Processing unit 13 can retrieve any information provided in the relations shown in FIGS. 2 and 3 from the relational database 20 by means of the indicated primary keys, or other attributes which uniquely identify a record in a relation.

Returning to FIG. 5, in a next step 413, a text message or a voice message is assembled from the retrieved event and location information. In the present example, such a text message could be "A8 München—Stuttgart: von AS Sulzemoos bis AS Odelzhausen: dichter Verkehr auf 4 km" for the language setting German (DE). As mentioned above, a voice message may additionally or alternatively be assembled by making use of the corresponding phoneme representations or the pre-recorded voice output.

In the last step 414, the text message or the voice message is given out to a user of the TMC client device.

It should be clear that the method described with respect to FIGS. 4 and 5 may, with the necessary changes, similarly be performed on the traffic information client device 10 when implemented as a TPEG client device receiving a TPEG message and using TMC location referencing. In this case, steps 402, 404, 405 would not need to be performed. Instead, a TPEG event code read from the TPEG message received in step 401 can then be converted into an event text using the TPEG client software. In step 406, the TMC location code, as well as cc, ecc (if applicable) and ltn may be read from the TMC location container of the received TPEG message.

Figure 6:
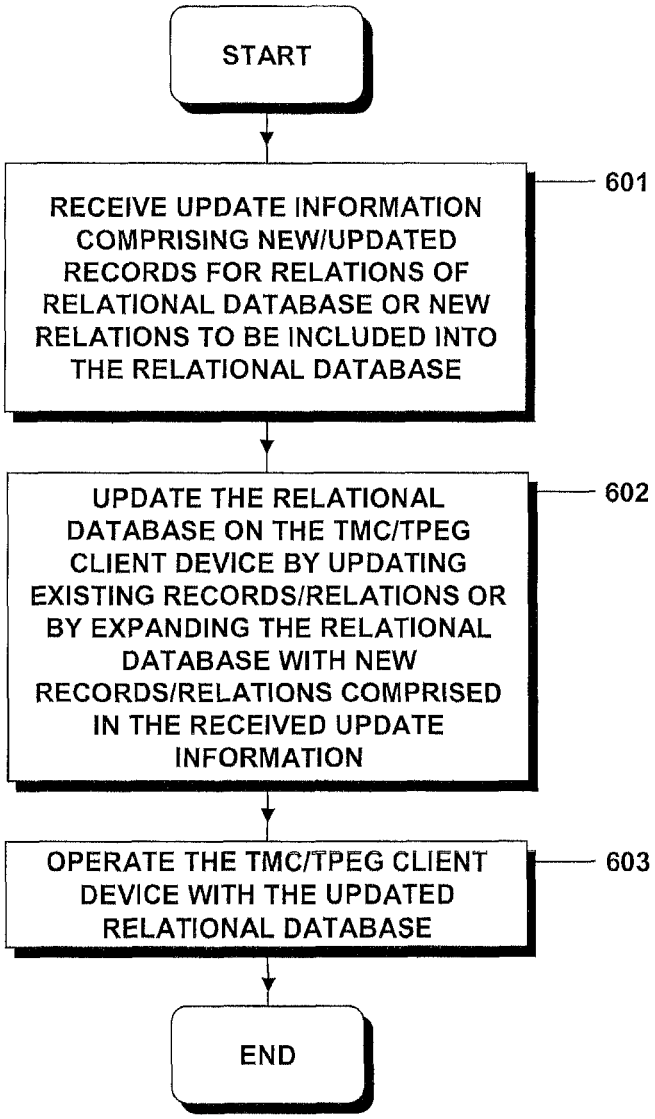
FIG. 6 is a flow diagram illustrating the updating of a relational database according to an implementation of the invention.

FIG. 6 illustrates the updating of the relational database 20 on the traffic information client device 10. In a first step 601, update information comprising new or updated records or relations of the relational database or new relations to be included into the relational database are received, for example, on update interface 14 (FIG. 1). The relational database 20 (FIG. 1) on the traffic information client device 10 (FIG. 1) is updated in step 602 by updating the existing records/relations or by expanding the relational database with new records/relations comprised in the received update information. As the relational database 20 (FIG. 1) is provided separate from the traffic information client software, such an updating is possible without altering the client software. This greatly increases the flexibility of TMC or TPEG message encoding, as new types of information or new languages can be easily added, and existing records can be easily modified. In addition, new/changed locations due to road network constructions can be provided to the traffic information client device by updating the client database.

In the last step 603, the traffic information client device is operated with the updated relational database.

As can be seen from the above, storing the location information and possibly event information in the relational database of the traffic information client device separate from the client software makes it possible to modify the contents of the database independent from the client software, in particular without the need to reinstall the client software. Storing the location and event information in relational form facilitates the updating of the database contents, in particular the expansion of relations by further records, the modification of single records, the addition of further relations and the like. The TMC location information and the TMC event information can thus be brought up to a current state by the database update. Furthermore, by distributing the information among several relations, the required storage space is reduced, and the performance when accessing records is improved. This also enables the selective loading of parts of the database into a main memory of the client device, thereby reducing the amount of required main memory (memory footprint). The relational database further facilitates the displaying of traffic information on a map on the client device, the generation of text messages for traffic events to be displayed on the client device, the generation of voice output for traffic events to be played to the user, and the determination of costs associated with traffic events for a dynamic route calculation.

It will be understood, and is appreciated by persons skilled in the art, that one or more processes, sub-processes, or process steps described in connection with FIGS. 1-6 may be performed by hardware and/or software. If the process is performed by software, the software may reside in software memory (not shown) in a suitable electronic processing component or system such as, one or more of the functional components or modules schematically depicted in FIGS. 1-6. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any means that may contain, store or communicate the program for use by or in connection with the instruction execution system, apparatus, or device. The computer readable medium may selectively be, for example, but is not limited to, an electronic, magnetic, optical, electromagnetic, infrared, or semiconductor system, apparatus or device. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An electronic device configured to operate as a traffic information client, comprising:

an interface adapted to receive traffic information messages, where a traffic information message comprises a location code which identifies a location of a traffic event;

a memory;

a relational database stored in the memory, the relational database comprising at least a first set of relations including at least one relation which directly or indirectly associates location codes with location information; and a processing unit adapted to query the relational database with a location code received with a traffic information message in order to retrieve the associated location information from the relational database, where the relational database further comprises a second set of relations including an event name relation directly or indirectly associating event codes with event texts, the event name relation comprising records for the event text in two or more different languages, the relation further comprising an attribute with a language code which identifies the language in which the event text is provided in each record.

2. The electronic device of claim 1, where a traffic information message further comprises an event code which identifies a traffic event, and where the second set of relations includes at least one relation which directly or indirectly associates event codes with event information, the processing unit being adapted to query the relational database with an event code received with a traffic information message in order to retrieve the associated event information from the relational database.

3. The electronic device of claim 1, where the first set of relations comprise a first relation having a plurality of records with location codes for different countries, where the records for different countries comprise the same location codes, and where the first relation comprises an attribute associating each record of the first relation with a unique location identifier.

4. The electronic device of claim 1, where the first set of relations comprises a first relation associating the location code with an identifier, preferably a unique location identifier and/or a location name identifier, and one or more second relations each for a particular type of location information associating the identifier with the corresponding location information, the first relation thus providing an indirect association with the location information.

5. The electronic device of claim 4, where the one or more second relations comprise at least one of the following relations:

an area location relation with area location information;

a segment location relation with segment location information;

a point location relation with point location information;

a location name relation with location name information;

a location type relation with location type information; and a location coordinate relation with coordinate information.

6. The electronic device of claim 5, where the first relation associates the location code with a location category identifier indicating whether the corresponding location is an area location, a linear location or a point location, the processing unit being adapted to identify a location category of a received location code by querying the relational database and to retrieve, in dependence on the identified location category, further location information either from the area location relation, the segment location relation or the point location relation using the identifier, preferably the unique location identifier, as a search query.

7. The electronic device of claim 5, where the first relation, the segment location relation and/or the location type relation comprise an attribute associating each record with a location name identifier, the location name relation comprising records associating the location name identifiers with location names.

8. The electronic device of claim 1, where the first set of relations comprises an area location relation directly or indirectly associating a location code with at least one or a combination of the following attributes:

an attribute indicating whether the area corresponding to the location code is a service broadcast area; and an attribute comprising an abbreviation of a state in which the area corresponding to the location code is located.

9. The electronic device of claim 1, where the first set of relations comprises a location name relation directly or indirectly associating location codes with location names, the location name relation comprising records for the location names in two or more different languages, the relation further comprising an attribute with a language code which identifies the language in which the location name is provided in each record.

10. The electronic device of claim 9, where the event name relation or the location name relation further associates the event text or location name with a phoneme identifier for retrieving a phoneme representation of the corresponding event text or location name and/or with a voice identifier for retrieving an acoustic representation of the corresponding event text or location name, respectively.

11. The electronic device of claim 2, where the second set of relations comprises an event relation directly or indirectly associating the event code with at least one or a combination of the following attributes:

an icon set identifier identifying an icon set associated with an event code:

an event nature identifying the nature of the event;

a duration type comprising information for the determination of a duration of a corresponding traffic message channel (TMC) message;

a default directionality indicating whether the event relates to one or both directions of traffic;

a jam category indicating a severity of the traffic event;

an update class identifying the update class of the event; and a quantifier type indicating a type of a quantifier which is allowed to be combined with the event.

12. The electronic device of claim 1, where the relational database further comprises a station list relation associating a country identifier comprised in received traffic message channel (TMC) messages with a program identifier identifying a radio program.

13. The electronic device of claim 1, where the location codes are traffic message channel (TMC) location codes and where the electronic device is configured to operate as a TMC or a transport protocol experts group (TPEG) client.

14. The electronic device of claim 1 further comprising a traffic information client including the interface, the memory, the relational database, and the processing unit.

15. The electronic device of claim 2, where the second set of relations comprises an event relation directly or indirectly associating the event code with an event urgency indicating an urgency of the event.

16. A non-transitory electronically readable data carrier comprising a processing unit and a relational database stored thereon, the relational database comprising at least a first set of relations including at least one relation which directly or indirectly associates location codes with location information, where the relational database is in electronic communication with an interface adapted to receive traffic information messages, where a traffic information message comprises a location code which identifies a location of a traffic event, where a traffic information message further comprises an event code which identifies a traffic event, and where the relational database further comprises a second set of relations including at least one relation which directly or indirectly associates event codes with event information, the processing unit being adapted to query the relational database with an event code received with a traffic information message in order to retrieve the associated event information from the relational database, and where the second set of relations comprise an event name relation directly or indirectly associating event codes with event texts, the event name relation comprising records for the event text in two or more different languages, the relation further comprising an attribute with a language code which identifies the language in which the event text is provided in each record.

17. The non-transitory electronically readable data carrier of claim 16, where the first set of relations comprises a first relation associating the location code with an identifier, preferably a unique location identifier and/or a location name identifier, and one or more second relations each for a particular type of location information associating the identifier with corresponding location information, the first relation providing an indirect association with the location information.

18. The non-transitory electronically readable data carrier of claim 17, where the one or more second relations comprise at least one of the following relations:

an area location relation with area location information;

a segment location relation with segment location information;

a point location relation with point location information;

a location name relation with location name information;

a location type relation with location type information; and a location coordinate relation with coordinate information.

19. The non-transitory electronically readable data carrier of claim 18, where the first relation associates the location code with a location category identifier indicating whether tile corresponding location is an area location, a linear location or a point location, the processing unit being adapted to identify the location category of a received location code by querying the relational database and to retrieve, in dependence on the identified location category, further location information either from the area location relation, the segment location relation or the point location relation using the identifier, preferably the unique location identifier, as a search query.

20. The non-transitory electronically readable data carrier of claim 18, where the first relation, the segment location relation and/or the location type relation comprise an attribute associating each record with a location name identifier, the location name relation comprising records associating the location name identifiers with location names.

21. The non-transitory electronically readable data carrier of claim 16, where the first set of relations comprises an area location relation directly or indirectly associating a location code with at least one or a combination of the following attributes:

an attribute indicating whether the area corresponding to the location code is a service broadcast area; and an attribute comprising an abbreviation of a state in which the area corresponding to the location code is located.

22. The non-transitory electronically readable data carrier of claim 16, where the first set of relations comprises a location name relation directly or indirectly associating location codes with location names, the location name relation comprising records for the location names in two or more different languages, the relation further comprising an attribute with a language code which identifies the language in which the location name is provided in each record.

23. The non-transitory electronically readable data carrier of claim 22, where the event name relation or the location name relation further associates the event text or location name with a phoneme identifier for retrieving a phoneme representation of the corresponding event text or location name and/or with a voice identifier for retrieving an acoustic representation of the corresponding event text or location name, respectively.

24. The non-transitory electronically readable data carrier of claim 16, where the second set of relations comprises an event relation directly or indirectly associating the event code with at least one or a combination of the following attributes:

an icon set identifier identifying an icon set associated with an event code:

an event nature identifying the nature of the event;

a duration type comprising information for the determination of a duration of a corresponding traffic message channel (TMC) message;

a default directionality indicating whether the event relates to one or both directions of traffic;

a jam category indicating a severity of the traffic event;

an update class identifying the update class of the event; and a quantifier type indicating a type of a quantifier which is allowed to be combined with the event.

25. The non-transitory electronically readable data carrier of claim 16, where the relational database further comprises a station list relation associating a country identifier comprised in received traffic message channel (TMC) messages with a program identifier identifying a radio program.

26. The non-transitory electronically readable data carrier of claim 16, where the location codes are traffic message channel (TMC) location codes and where an electronic device is configured to operate as a TMC or a transport protocol experts group (TPEG) client.

27. The non-transitory electronically readable data carrier of claim 16, where the second set of relations comprise an event relation directly or indirectly associating the event code with an event urgency indicating an urgency of the event.

* * * * *